US007028860B2

(12) United States Patent
Behnke et al.

(10) Patent No.: US 7,028,860 B2
(45) Date of Patent: Apr. 18, 2006

(54) INTER-FOLDED SHEET DISPENSER WITH REPLACEABLE CARTRIDGE

(75) Inventors: Janica S. Behnke, Appleton, WI (US); Kathleen R. Rigotti, Neenah, WI (US); Katie L. Thomas, Wrightstown, WI (US); Timothy P. Hartjes, Kimberly, WI (US); Michael R. Kilgore, Little Suamico, WI (US); Gregory D. Budz, Sobieski, WI (US)

(73) Assignee: Fort James Corporation, Atlanta, GA (US)

( * ) Notice: Subject to any disclaimer, the term of this patent is extended or adjusted under 35 U.S.C. 154(b) by 234 days.

(21) Appl. No.: 10/772,967

(22) Filed: Feb. 5, 2004

(65) Prior Publication Data

US 2004/0169047 A1 Sep. 2, 2004

Related U.S. Application Data

(60) Provisional application No. 60/446,293, filed on Feb. 10, 2003.

(51) Int. Cl.
*A47K 10/24* (2006.01)

(52) U.S. Cl. ..... 221/49; 221/50; 221/52

(58) Field of Classification Search ..... 312/34.18, 312/50

See application file for complete search history.

(56) References Cited

U.S. PATENT DOCUMENTS

| | | | | | |
|---|---|---|---|---|---|
| 404,622 | A | * | 6/1889 | Hicks | 221/48 |
| 2,005,490 | A | | 6/1935 | Baxter | 206/57 |
| 2,101,307 | A | * | 12/1937 | Bodette | 221/59 |
| 2,195,622 | A | | 4/1940 | Fourness et al. | 206/57 |
| 3,209,941 | A | * | 10/1965 | Krake | 221/48 |
| 3,265,241 | A | | 8/1966 | McColgan | 221/47 |
| 3,369,700 | A | | 2/1968 | Nelson | 221/63 |
| 3,456,843 | A | | 7/1969 | Planner | 221/63 |
| 3,456,844 | A | | 7/1969 | Planner | 221/63 |
| 3,700,138 | A | | 10/1972 | Nelson | 221/51 |
| 4,231,491 | A | * | 11/1980 | Pierson et al. | 221/48 |
| 5,128,182 | A | | 7/1992 | Bunker et al. | 428/34.3 |
| 5,462,197 | A | | 10/1995 | Pound | 221/46 |
| 5,582,674 | A | | 12/1996 | Patterson et al. | 156/290 |
| 6,202,889 | B1 | | 3/2001 | Veith | 221/58 |
| 6,213,345 | B1 | | 4/2001 | Plank | 221/46 |
| 6,349,525 | B1 | | 2/2002 | Veith | 53/429 |

* cited by examiner

*Primary Examiner*—Gene O. Crawford
*Assistant Examiner*—Timothy Waggoner
(74) *Attorney, Agent, or Firm*—Georgia-Pacific Corporation; Jacqueline M. Hutter

(57) ABSTRACT

A dispenser for inter-folded sheet includes a replaceable cartridge. In preferred embodiments, the replaceable cartridge includes a generally planar rectangular core having a stack of inter-folded food service sheets wrapped around the core in a U-shape and retained in position by shrink wrap.

46 Claims, 6 Drawing Sheets

INTER-FOLDED SHEET DISPENSER WITH REPLACEABLE CARTRIDGE

CLAIM FOR PRIORITY

This non-provisional application claims the benefit of the filing date of U.S. Provisional Patent Application Ser. No. 60/446,293, of the same title, filed Feb. 10, 2003.

TECHNICAL FIELD

The present invention relates generally to dispensers for inter-folded sheet. More particularly, the invention is directed in a preferred embodiment to a dispensing system including a cartridge with a stack of inter-folded food service sheets secured to a generally planar rectangular core by way of shrink wrap.

BACKGROUND OF INVENTION

Dispensers for inter-folded sheet are known in the art. There is shown, for example, in U.S. Pat. No. 6,213,345 to Plank a pop-up tissue dispenser including a replaceable clip of tissues which are dispensed through an aperture generally perpendicular to the axis of the roll of sheets. It is noted in the '345 patent that the clips of tissues could be available as single pre-packaged units wrapped in a thin plastic film or shrink wrap to maintain the proper tissue interleaving pattern and orientation. See Column 3, lines 47–54.

There is disclosed in U.S. Pat. Nos. 6,202,889 and 6,349,525, both to Veith, an upright facial tissue carton with a top wall, four side-walls, and a bottom wall. The top wall has an aperture formed through which tissue can be withdrawn. Tissue is provided to the dispenser in the form of an inverted U-shaped clip of inter-folded tissue positioned within the carton. Other dispensing systems for inter-folded sheet material and the like may be found in the following: U.S. Pat. No. 2,005,490 to Baxter; U.S. Pat. No. 2,195,622 to Fourness et al.; U.S. Pat. No. 3,209,941 to Krake; U.S. Pat. No. 3,265,241 to McColgan; U.S. Pat. No. 3,369,700 to Nelson; U.S. Pat. No. 3,456,844 to Planner; U.S. Pat. No. 3,456,843 also to Planner; U.S. Pat. No. 3,700,138 to Nelson; and U.S. Pat. No. 5,462,197 to Pound, all of which patents disclose various features in connection with dispensing sheet products.

SUMMARY OF INVENTION

There is provided in accordance with the present invention a dispenser for dispensing inter-folded sheet which includes a dispenser housing and a replaceable cartridge of inter-folded sheet. Generally speaking, the dispenser housing includes a base wall, two lateral walls, a front wall and a back wall as well as an upper dispensing wall provided with a dispensing aperture. Typically the lateral sidewalls have support means such as channels or a like means for engaging the dispenser cartridge of the dispensing system.

In preferred embodiments, the dispenser is provided with a spring to maintain the sheets in proximity with the dispensing aperture, and the lid and walls of the dispenser are shaped to facilitate loading and removal of a cartridge. This latter characteristic is achieved by providing "low profile" front and back walls. There is optionally provided adapter plates to configure a dispenser to accommodate cartridges of different sizes.

The dispensing cartridge preferably includes a medial support member as well as a folded stack of inter-folded sheets disposed thereabout and retained in position by a retaining member which may be of any suitable construction but preferably is a shrink wrap envelope. The support member may be any longitudinally extending structure capable of providing vertical support to the folded stack of inter-folded sheets about the innermost fold in the stack when the stack is in the housing on the support member and engages the support means found in the lateral walls of the housing. For example, the support member may be a U, V, rod or tubular shaped support member or, more preferably, a rectangular, generally planar, core member as described and illustrated hereinafter. In a preferred embodiment the dispenser cartridge includes a generally planar rectangular core defining an upper core edge, a lower core edge and two lateral edges. A stack of inter-folded sheets is wrapped about the upper edge of the generally planar rectangular core in a U-shape, the stack and core being sized such that the lateral edges of the core preferably extend outwardly from the U-shaped stack a predetermined distance. A shrink wrap envelope about the stack secures the U-shaped stack of inter-folded sheets about the core and is provided with a dispensing line or lines of weakness providing a dispensing region generally parallel to the upper edge of the core. The inter-folded sheets are secured about the core such that their tail edges are generally parallel with the surface of the dispensing region of the envelope. This cartridge is placed in the dispenser housing including a base, two lateral walls, a front wall, a back wall and an upper dispensing wall provided with a dispensing aperture wherein the lateral sidewalls have support means for engaging the lateral edges of the rectangular core extending from the U-shaped stack of inter-folded sheets. The lateral wall support means are configured to support the cartridge such that the dispensing region of the shrink wrap envelope is presented to the dispensing aperture. In such embodiments, the lower edge of the core optionally extends outwardly from the stack of U-shaped sheets secured thereto and the base wall of the housing has a channel which secures the lower edge of the core of the cartridge when the cartridge is placed therein. The support channels of the housing help keep the shrink wrap in place and are operative to maintain the stack in proper interleaved configuration. Generally speaking, three edges of the generally planar rectangular core extend beyond the U-shaped stack of inter-folded sheets attached thereto a distance of anywhere from about 1/16" to about 1/2". A typical distance is from about 1/8" to about 1/4" so that there is sufficient distance to easily lockingly engage support channels in the dispenser housing to secure the cartridge in place. The cartridge is preferably secured so that the dispensing region of the cartridge is coincident with or adjacent to the dispensing aperture of the dispenser housing.

Typically, the shrink wrap envelope has a perforate line to define the dispensing region. Further included may be a band securing the U-shaped stack about the core, the band is in addition to the shrink wrap generally securing the U-shaped stack about the core. The band preferably has a perforated area to make it easier to tear so as to release the sheet.

In a preferred embodiment the stack of inter-folded sheets is a stack of single fold inter-folded sheet and in preferred embodiments is a stack of inter-folded single fold food service sheets. Such sheets may have any suitable size, for example, typical sizes for rectangular sheets are: 6"×10¾", 8"×10¾", 10"×10¾", 12"×10¾" or 15"×10¾".

In another aspect of the invention there is provided a method of dispensing a stack of inter-folded sheets including providing a dispenser cartridge of the type described above and securing the cartridge in a dispenser housing having support means configured to engage the edges of the medial support member of the inter-folded sheet cartridge. In the method of the invention the shrink wrap envelope remains in place between the core and support channels of the dispenser. After the cartridge is positioned, a dispensing line of weakness in the envelope is fractured to form a dispensing region and the sheets are withdrawn from the stack therethrough. The present invention has many advantages, for example, the support core will hold the stack of sheets upwardly adjacent to the dispensing aperture as the stack is depleted. Moreover, since food service sheets such as bakery tissue are very resilient and have surfaces with a relatively low coefficient of friction, the shrink wrap is needed to maintain the proper stack configuration particularly as the stack nears depletion. The shrink-wrap holds the stack in place and operates to hold the sheets in their U-shape thus saving countertop space as will be appreciated by one of skill in the art. These and other advantages of the invention will be readily apparent from the discussion which follows.

BRIEF DESCRIPTION OF DRAWINGS

The invention is described in detail below with reference to the drawings wherein like numbers designate similar parts and wherein.

DETAILED DESCRIPTION

Figure 1:
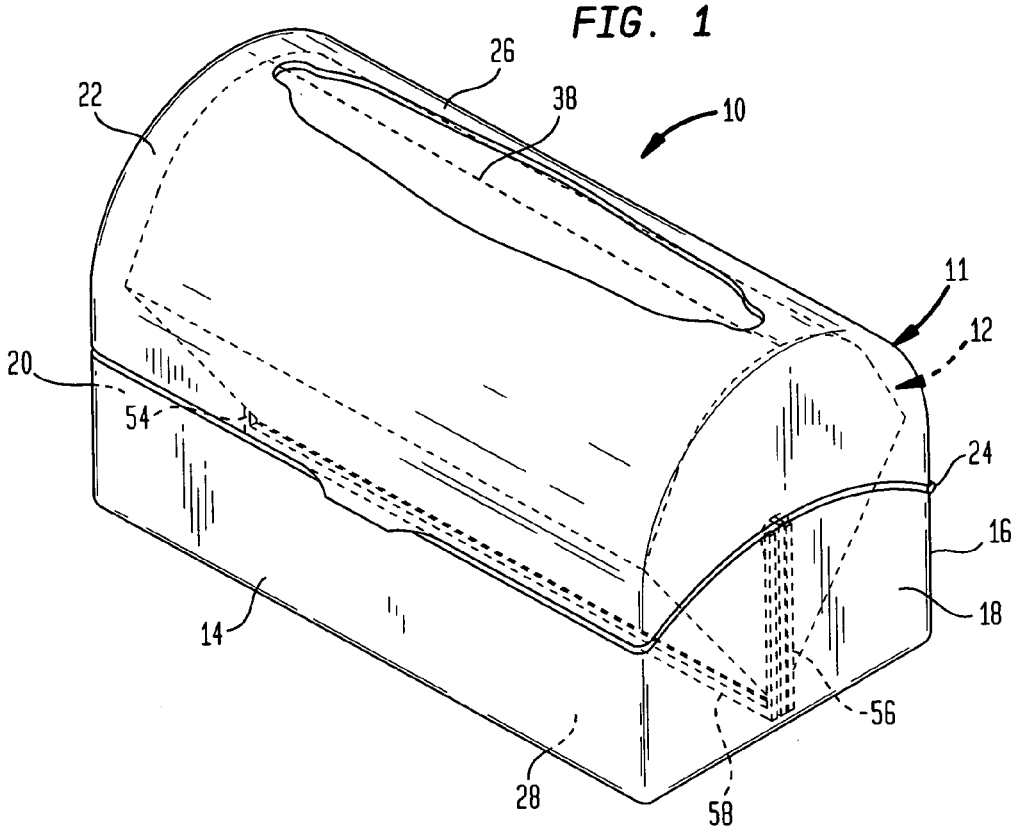
FIG. 1 is a view in perspective, partially in phantom lines, showing a dispenser configured in accordance with the present invention provided with a replaceable cartridge of inter-folded bakery sheets folded about a rectangular stack support.

The invention is described in detail below with reference to several embodiments. Such exemplification is for purposes of explanation and discussion only and is not intended to limit in any way the scope of the invention which is defined solely in the appended claims. Referring generally to FIGS. 1, 2, 3, 4, 5 and 6, there is shown a dispenser 10 configured in accordance with the present invention. Dispenser 10 includes a dispenser housing 11 provided with a replaceable cartridge of inter-folded sheets 12. Housing 11 includes a front wall 14, a back wall 16, sidewalls 18 and 20 as well as a lid 22. Lid 22 is secured to the remainder of the housing by way of a hinge 24 which is provided to open and close the housing as necessary in order to replace cartridge 12 as needed. Lid 22 also includes an elongated dispensing aperture 26 which is generally elongated and extends along its central axis between sidewalls 18 and 20 as shown in the Figure. Housing 11 also includes a base wall 28 indicated on FIG. 1 in dashed lines.

Figure 2:
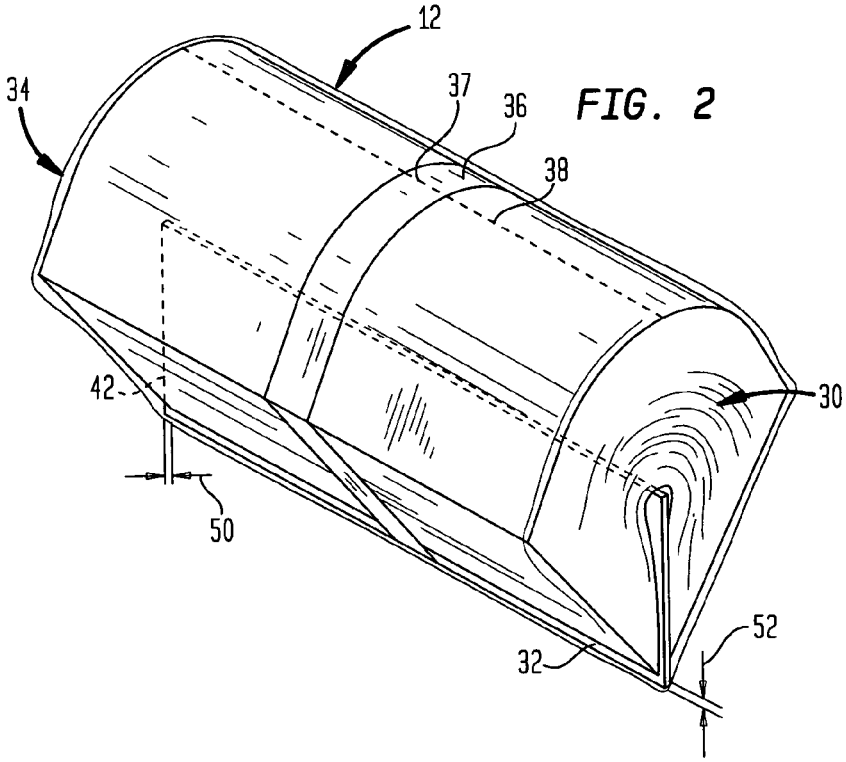
FIG. 2 is a view in perspective of an inter-folded sheet cartridge of the type shown in FIG. 1.
Figure 3:
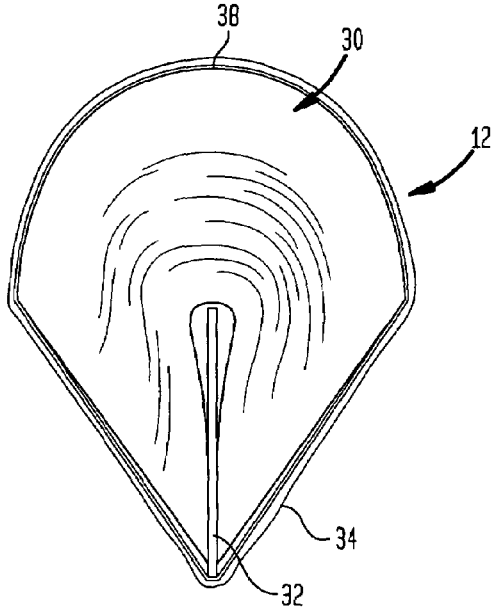
FIG. 3 is an end view in elevation illustrating the cartridge of inter-folded sheets shown in FIG. 2.
Figure 4:
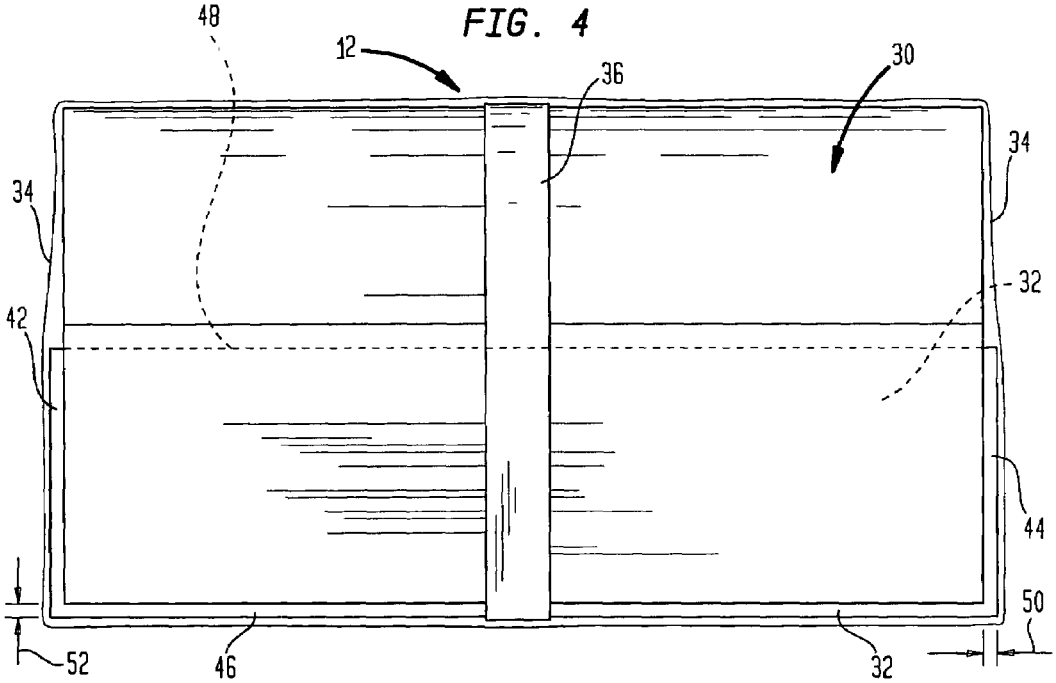
FIG. 4 is a side view in elevation of the cartridge of inter-folded sheets shown in FIGS. 2 and 3.

Cartridge 12 is better illustrated in FIGS. 2, 3 and 4. FIG. 2 is a view in perspective of a cartridge configured in accordance with the present invention, while FIGS. 3 and 4 are end views and side views in elevation respectively of cartridge 12. Cartridge 12 includes a stack of inter-folded sheets 30 wrapped around a central core 32 and secured in place by a shrink wrap envelope 34 as well as a paper band 36 as shown in the various diagrams. Band 36 preferably includes a perforate region indicated at 37 to facilitate rupturing.

Figure 7:
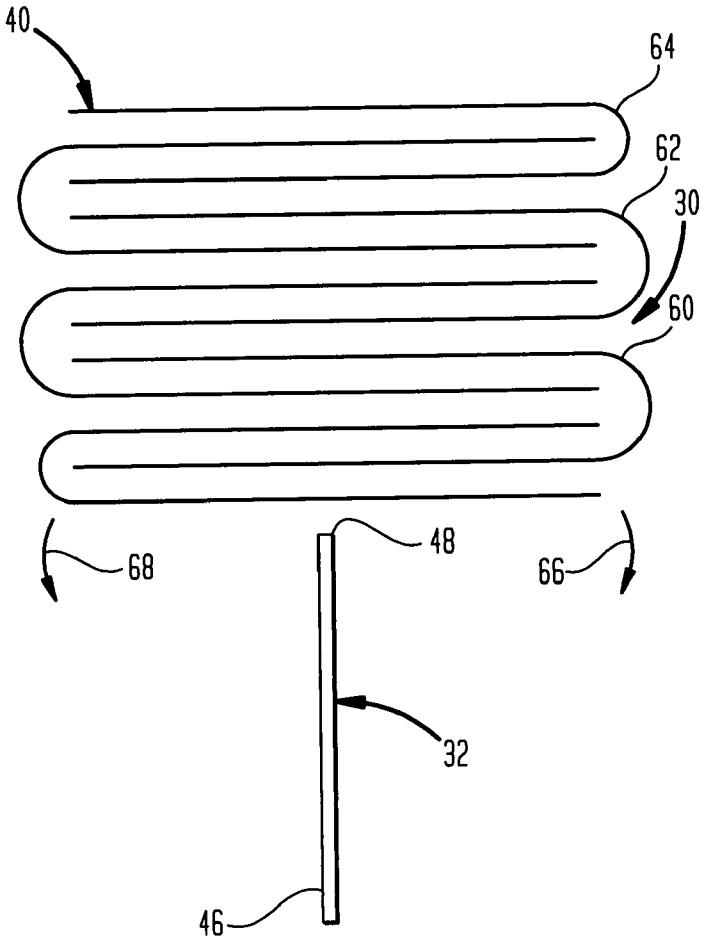
FIG. 7 is a schematic view showing a stack of inter-folded sheets in a single fold configuration being prepared for folding about a generally planar support member in accordance with the invention.
Figure 5:
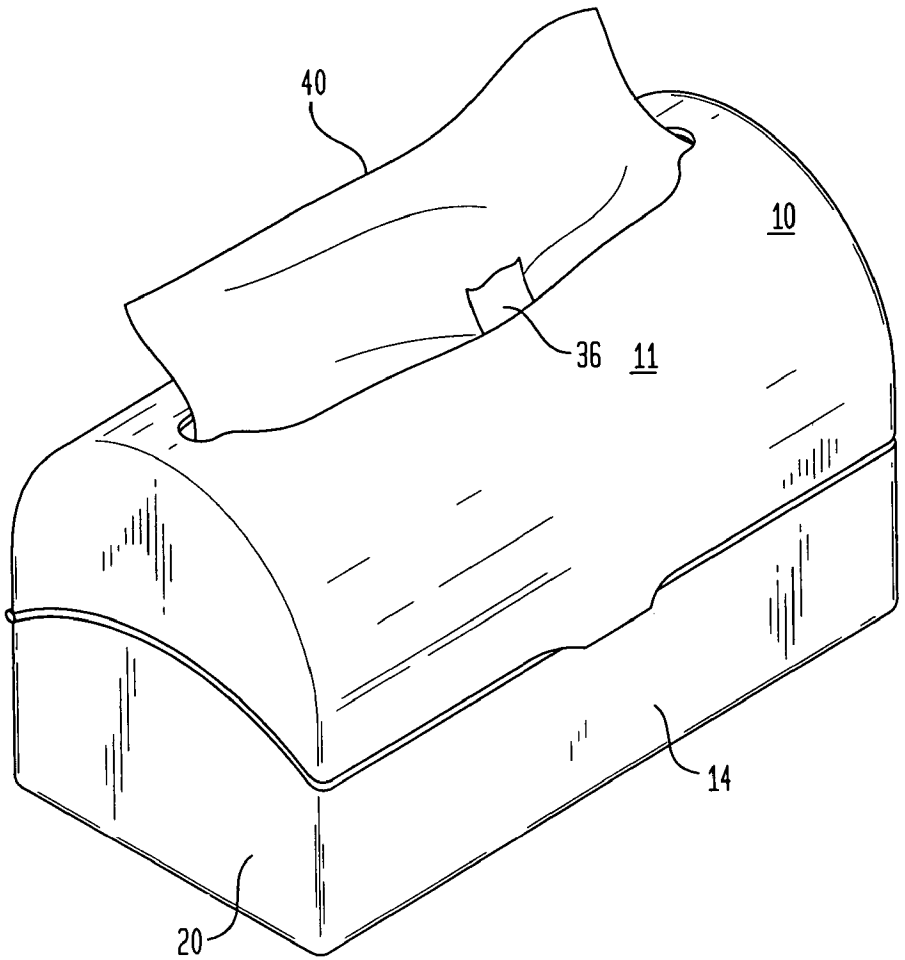
FIG. 5 is a view in perspective showing the inventive sheet dispenser of FIG. 1 in operation.

Shrink wrap envelope 34 includes a perforate line 38 at the upper edge of the cartridge as is seen in FIGS. 1, 2 and 3 along the stack generally parallel to the dispensing or tail edges of the sheets. As illustrated, the dispensing region is defined by perforate line 38 and includes the surface of the shrink wrap envelope in the area which is fractured so that sheets can be withdrawn from the stack at that portion. The dispensing region may be defined by a single perforate line, a perforate elongated rectangle, elongated oval or the like, all of which have their longitudinal axis generally parallel to line 38 such that the surface of the dispensing region is generally parallel to the tails of the sheets to be dispensed. The dispensing region of the envelope is generally parallel to the tails of the sheets to be dispensed in that the edges 40 of the sheets are aligned with the longitudinal axis of the dispensing region (line 38 in FIGS. 1, 2, 3) as opposed to perpendicular to that axis as would be the case with a pop-up tissue dispenser, for example. The stack of inter-folded sheets 30 is in preferred embodiments a stack of single fold food service sheets. "Food service sheets" include bakery tissue, bakery sheets, deli sheets and sandwich wrap such as, e.g., Quilt-Rap® sandwich wrap, all of which are further described below. Generally speaking bakery sheets are paper which has been impregnated with wax or binder to make a relatively grease and moisture resistant substrate for handling of food products, for example. Such sheet is more resilient than facial tissue and requires the shrink wrap envelope for proper performance of the inventive system. The band 36 on the other hand is optionally included. The stack of inter-folded sheet is arranged in a U-shape such that their tail or dispensing edges 40 as shown in FIGS. 5 and 7 for example are generally parallel to the surface of the dispensing region defined as shown by perforate line 38. Bakery tissue is generally sized as 6"×10¾" sheets, 8"×10¾" sheets, 10"×10¾" sheets, 12"×10¾" sheets or 15"×10¾" sheets such that their panels are roughly 5⅜" in a direction transverse to their dispensing width in the various embodiments. Similarly, the dispenser of the present invention is also well adapted for dispensing of deli sheets which are generally similar to bakery sheets and bakery tissue except that deli sheets are generally a little heavier in basis weight, typically nominally in the range of from about 15 lbs. per 3000 square foot ream to about 23 lbs. per 3000 square foot ream, while bakery tissues and sheets are most usually in the range of 10 lbs.–14 lbs. per 3000 square foot ream. The dispenser of the present invention is also well suited to dispensing Quilt-Rap® sheets sometimes referred to here as sandwich wrap as are described in U.S. Pat. No. 5,582,674 to Patterson et al. and U.S. Pat. No. 5,128,182 to Bunker et al., the disclosure of which is incorporated herein by reference.

Core 32 is sized with respect to the dispenser and sheets such that its edges engage support means which may be in the form of channels or slots 54, 56 formed in the sidewalls of the dispenser and preferably the edges of the core protrude around the U-shaped stack on three sides or edges thereof as is appreciated particularly from FIGS. 2, 4 and 7. Core 32 has two lateral edges 42, 44 a lower edge 46 and an upper edge 48. Lateral edges 42, 44 preferably extend a lateral distance 50 away from the edge of stack 30 and the core extends a distance 52 below the stack in a direction generally perpendicular to the lateral stack edges. These edges of the cores are operable to secure cartridge 12 in the dispenser housing as is seen in FIG. 1. That is to say, housing 11 is provided with a pair of lateral slots 54, 56 in sidewalls 20 and 18 as well as a lower slot 58 in base wall 28 to receive the protruding portions of the core of the inter-folded sheet cartridge as shown in FIG. 1 in order to secure the cartridge in place. Once secured in place the sheets can be withdrawn from the U-shaped stack by fracturing perforated line 38 and withdrawing the sheet as is shown in FIG. 5 by grasping their edge 40. Note that the core as held in place vertically will support the stack even as it is depleted such that the sheets do not become difficult to access as the stack is depleted.

So also, the shrink wrap envelope holds the stack in place such that the stack does not dissipate into individual sheets and become difficult to grasp. That is to say, if the stack of inter-folded sheets slides apart, a sheet when withdrawn will not drag the tail of a subsequent sheet through the dispensing aperture so that it will be readily available to a user. Note that when placed in the slots 54, 56 formed in the sidewalls the cartridge is configured such that the perforate line 38 is presented to the aperture 26 such that the perforate line 38 is generally along the axis of dispensing aperture 26 and the folds in the sheets are generally parallel to both the dispensing line 38 and the axis of dispensing aperture 26. Other suitable supports for cartridge 12 may be internally projecting bosses in the dispenser interior that compress the stack slightly and engage the core to hold it in a vertical position in which cases the edges of the core and stack can essentially coincide.

Figure 6:
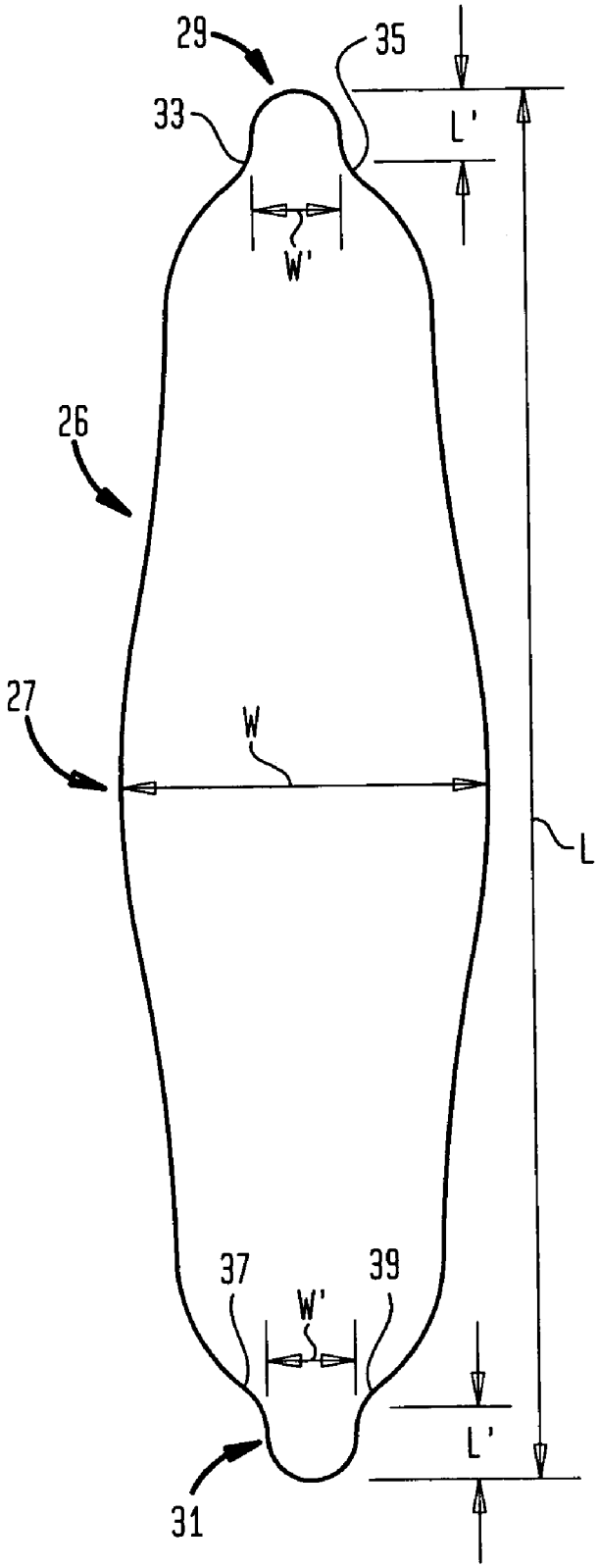
FIG. 6 is a diagram illustrating the geometry of the dispensing aperture of the inventive dispenser.

There is shown in FIG. 6 a diagram illustrating a preferred configuration of dispenser aperture 26. Aperture 26 extends over a length, L, which is generally the same length as the width (that is, length of tail 40) of the inter-folded sheets dispensed therethrough. Aperture 26 has a slightly widened portion indicated at 27 at its central region as well as narrowed or restricted portions 29, 31 at its terminal portions as shown in the diagram. Portions 29, 31 are defined by inward projections 33, 35, 37, 39 of the dispenser lid to narrow the aperture width to a relatively small width, W', relative to width, W, at 27, for example, over a length, L'. Inasmuch as length L is generally equal to the dispensing width of the sheets in the stack, the sheets are held in a generally vertical posture by portions 29, 31 of aperture 26 because of the narrowed width, W', of the terminal portions of the aperture over length, L', thereof as is seen in FIG. 5. That is to say, the narrowed terminal portions of the aperture operate to orient the tail generally vertically so that it is readily available for dispensing.

Thus, aperture 26 preferably is a longitudinally extending slot or oval substantially the same length as the width of the sheets to be dispensed which narrows significantly at its outermost extents so that projections 33, 35, 37, 39 will engage the next to be dispensed sheet and hold the next to be dispensed sheet in a generally vertical posture making it easier for the user to grasp and remove a sheet with one hand.

In some embodiments the inter-folded sheets are single fold sheets as shown schematically in FIG. 7 which is intended to show the procedure by which the U-shaped stack 30 of inter-folded sheets are prepared and wrapped around a rectangular core 32 of cardboard.

A stack of inter-folded sheets 30 includes a plurality of single fold sheets 60, 62 and 64 for example, which are interleaved as is well known in the art. The stack is placed adjacent core 32 and folded over in a U-shape as is shown for example in FIGS. 2, 3 and 4 and indicated schematically by arrows 66 and 68 in FIG. 6. Other methods of inter-folding the sheet could likewise be employed for example, such as C-fold or Z-fold or multi-fold configurations as are also well known in the art. The single fold configuration is particularly advantageous for bakery tissue due to the frictional properties of the sheet, that is to say the relatively low inter-sheet friction.

Figure 8:
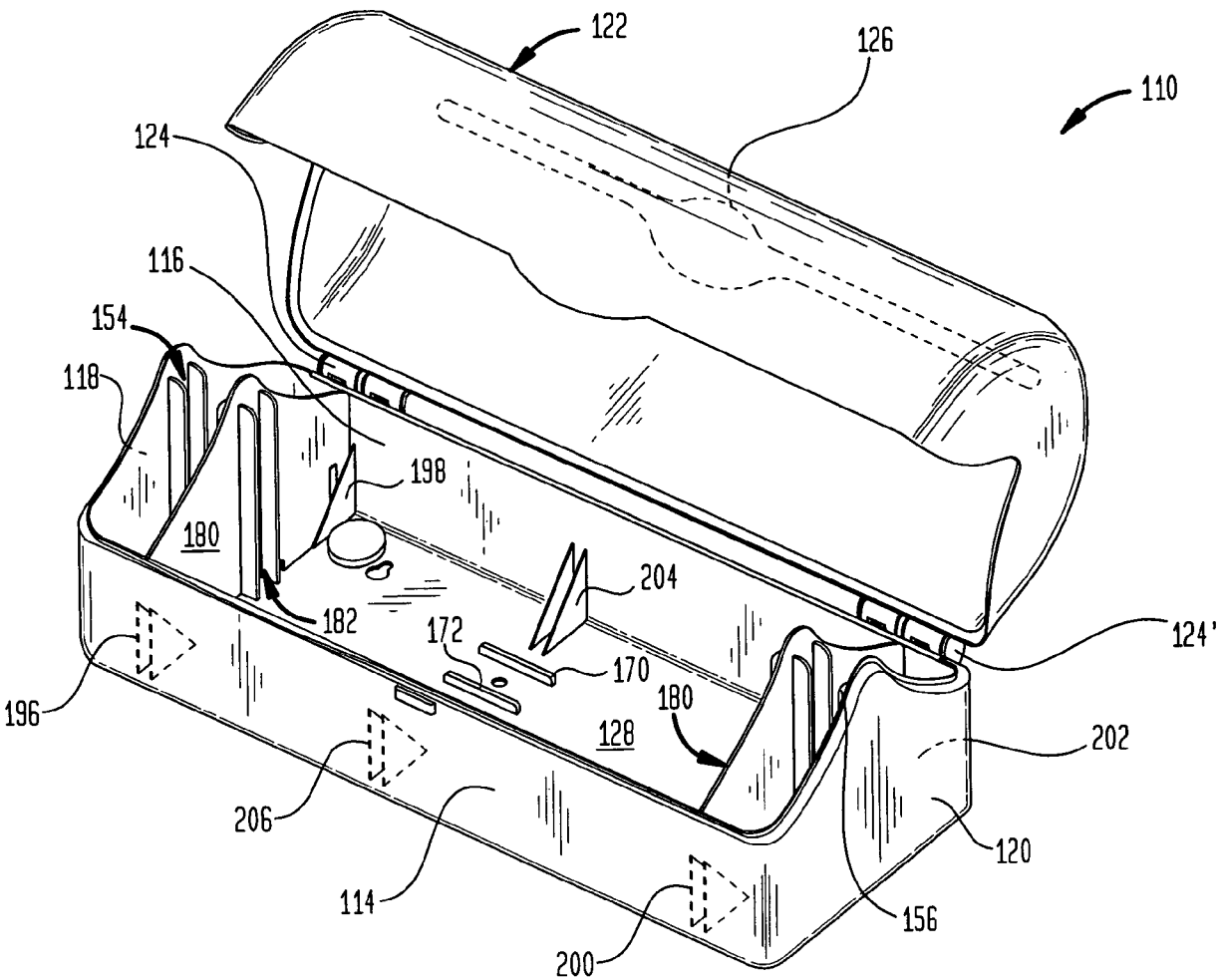
FIG. 8 is a view in perspective of another dispenser configured in accordance with the present invention.
Figure 9:
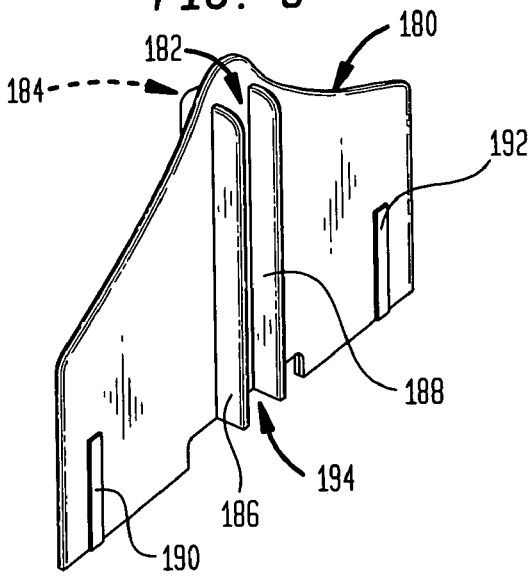
FIG. 9 is an enlarged detail showing an adapter plate.

Referring to FIGS. 8 and 9, there is shown another dispenser 110 configured in accordance with the present invention. Dispense 110 includes a front wall 114, a back wall 116, sidewalls 118 and 120 as well as a lid 122. Lid 122 is secured to the back wall by way of hinges 124 and 124' and has an aperture 126 on its apex.

Sidewall 118 has a slot 154 and sidewall 120 has a slot 156. Slots 154 and 156 are defined by a pair of vertically projecting ribs which may he integrally formed with the sidewalls when the dispenser is made by way of injection molding, for example.

Dispenser 10 is sized to receive a cartridge having a length of 12" in slots 154 and 156; however, any such suitable first length may be selected depending upon the product. These slots receive a cartridge with a 12" rectangular base, i.e., a cartridge of suitable length like that of FIG. 1 is disposed in slots 154, 156 in the same position as was shown in FIG. 1. There are optionally provided guide ribs 170, 172 to position springs of the type described in connection with FIG. 10.

The dispenser of FIG. 8 is adaptable to receive cartridges of second and third lengths by way of positioning one or more universal adapter plates of the type shown in FIG. 9.

Adapter plate 180 includes front vertical slot 182 and rear slot 184 each defined by a pair of opposed vertical ribs such as ribs 186 and 188. Plate 180 also includes wedge-shaped portions 190, 192 to help secure it in a slot as well as a cutaway 194 to accommodate features in the base. One or more of the adapter plates are used to configure dispenser 110 to receive a cartridge of second and third lengths.

There is shown in FIG. 8 two plates 180 disposed in intermediate slots 196, 198, 200 and 202. In this configuration, the dispenser is adapted to receive a 10" cartridge. If a 12" cartridge is used instead, the adapter plates are simply removed.

Likewise, dispenser 110 can be configured to receive two 6" cartridges by including only one plate 180 in central support slots 204 and 206. Thus, the universal adapter plates can be used to configure dispenser 110 to receive cartridges of three different lengths.

Additional features of the inventive dispenser include a central spring to facilitate product dispensing as the cartridge is consumed as well as low profile front and rear walls to facilitate replenishment. These features are discussed in connection with FIG. 10.

Figure 10:
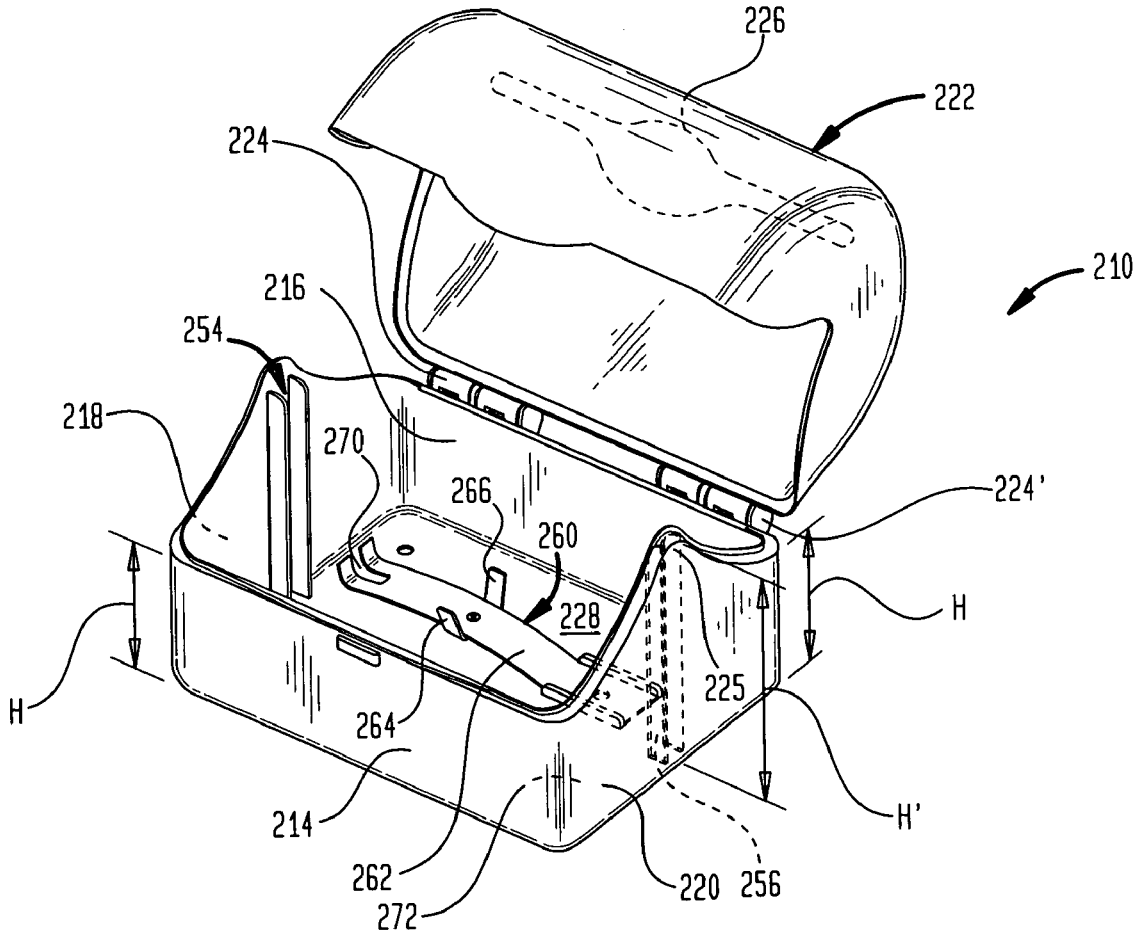
FIG. 10 is a view in perspective of yet another dispenser configured in accordance with the present invention.

In FIG. 10 there is shown another dispenser 210 having a front wall 214, a back wall 216, sidewalls 218, 220, a lid 222, hinges 224 and 224' as well as a base wall 228. A pair of vertical ribs defines vertical slots 254 and 256 as was discussed above in connection with FIG. 1 and following. In this case, slots 254 and 256 are spaced to accept a 6" cartridge.

A salient feature of the dispenser configuration are low profile front and back walls wherein front wall 214 and back wall 216 have a height, H, which is less than the height, H', of sidewalls 218, 220 as measured at the central portion. When the dispenser is open, the sidewalls are low enough so that they will not interfere with the hand of someone removing a spent cartridge or loading the dispenser with a fresh cartridge, while the sidewalls have an apex 225 which is high enough to provide adequate support for the cartridge. To this end, the height of the front wall is 1" or more lower than the height, H', of the sidewall, typically 1¼" lower or more.

It is also desirable to include a spring 260 in the dispenser to urge a cartridge upwardly as sheets are removed; otherwise, sheets of the cartridge may be inaccessible from aperture 226 when the cartridge is partially depleted and before the cartridge is completely depleted.

To this end, spring 260 is provided with an arched central portion 262, support tabs 264, 266 and a slotted end 270. The spring may be secured by a bolt 272 or any other suitable means.

When a cartridge is in the dispenser, slot 270 preferably engages the core as do slots 254, 266 and tabs 266, 264 as well as the spring 260 generally. Spring 260 urges the cartridge upwardly to dispensing slot 226, which is especially important as the cartridge is depleted. Preferably, the spring exerts an upward force on a cartridge placed into the dispenser of at least 50% or 75% of the weight of fresh cartridge and more preferably exerts an upward force of at least 100% of the weight of a fresh cartridge. A typical spring force is 0.8 lbs at the bottom of deflection.

The present invention also includes a method of dispensing sheet utilizing the inventive cartridge of inter-folded sheets as well as the cartridge themselves as will be appreciated from the foregoing discussion.

While the present invention has been illustrated in connection with various embodiments, modifications to specific embodiments within the spirit and scope of the present invention, set forth in the appended claims, will be readily apparent to those of skill in the art.

What is claimed is:

1. A dispenser for dispensing inter-folded sheet comprising:

(a) a dispenser housing including a base wall, two lateral walls, a front wall, a back wall and an upper dispensing wall provided with a dispensing aperture;

(b) a replaceable cartridge of inter-folded sheet comprising:

(i) a stack support member;

(ii) a stack of inter-folded sheets secured about the support member in a U-shape;

(iii) a shrink wrap envelope about the stack securing the U-shaped stack of the inter-folded sheets about the support member, the shrink wrap envelope being provided with a dispensing region, wherein the inter-folded sheets are secured about the support member such that their tail edges are generally parallel with the dispensing region of the envelope, and wherein the support member and the dispenser are configured such that the cartridge is supported so that the dispensing region coincides with the dispensing aperture of the dispenser.

2. The dispenser for dispensing inter-folded sheet according to claim 1, wherein the support member is a generally rectangular support member.

3. The dispenser for dispensing inter-folded sheet according to claim 1, wherein the support member is a generally rectangular core member having an upper core edge, a lower core edge and two lateral core edges, wherein the lateral core edges extend outwardly with respect to the U-shaped stack and cooperate with channels in the lateral walls of the dispenser to support the cartridge in the dispenser such that the dispensing region of the shrink wrap envelope coincides with the aperture of the dispenser.

4. The dispenser for dispensing inter-folded sheet according to claim 3, wherein the lateral core edges extend outwardly with respect to the U-shaped stack of inter-folded sheet a distance of from about 1/16" to about ½".

5. The dispenser for dispensing inter-folded sheet according to claim 4, wherein the lateral core edges extend outwardly with respect to the U-shaped stack of inter-folded sheets a distance of from about ⅛" to about ¼".

6. The dispenser for dispensing inter-folded sheet according to claim 1, wherein the dispensing aperture extends generally over the same length as the widths of the sheets to be dispensed and narrows significantly at its outermost extents so as to hold the next to be dispensed sheet in a generally vertical posture.

7. A dispenser for dispensing inter-folded sheet comprising:

(a) a dispenser housing including a base, two lateral walls, a front wall, a back wall and an upper dispensing wall provided with a dispensing aperture, wherein the lateral sidewalls of the dispenser housing are provided with support channels;

(b) a dispenser cartridge comprising:

(i) a generally planar rectangular core defining an upper core edge, a lower core edge and two lateral core edges;

(ii) a stack of inter-folded sheets wrapped about the upper edge of the generally planar rectangular core in a U-shape, the stack and core being sized such that lateral edges of the core extend outwardly from the U-shaped stack a predetermined distance therefrom;

(iii) a shrink wrap envelope about the stack securing the U-shaped stack of inter-folded sheets about the core, the shrink wrap envelope being provided with a dispensing region generally parallel to the upper edge of the core, wherein the inter-folded sheets are secured about the core such that their tail edges are generally parallel with the dispensing region of the envelope;

wherein further the cartridge and dispenser housing are configured such that the lateral edges of the core engage the support channels of the lateral walls of the dispenser housing and the cartridge is configured such that the dispensing line of the shrink wrap envelope is presented to the dispensing aperture of the housing.

8. The dispenser for dispensing inter-folded sheet according to claim 7, wherein the lower edge of the core of the cartridge extends outwardly from the stack of inter-folded sheet secured thereabout.

9. The dispenser for dispensing inter-folded sheet according to claim 8, wherein the base of the dispenser housing has a support channel for engaging the lower edge of the core of the cartridge in order to secure the cartridge in the housing.

10. The dispenser for dispensing inter-folded sheet according to claim 7, wherein the dispensing aperture extends generally over the same length as the widths of the sheets to be dispensed and narrows significantly at its outermost extents so as to hold the next to be dispensed sheet in a generally vertical posture.

11. An inter-folded sheet dispenser cartridge comprising:

(a) a generally planar rectangular core defining an upper core edge, a lower core edge and two lateral core edges;

(b) a stack of inter-folded sheets wrapped about the upper edge of the generally planar rectangular core in a U-shape, the stack and core being sized such that lateral edges of the core extend outwardly from the U-shaped stack a predetermined distance therefrom; and (c) a shrink wrap envelope about the stack securing the U-shaped stack of inter-folded sheets about the core, the shrink wrap envelope being provided with a dispensing region generally parallel to the upper edge of the core, wherein the inter-folded sheets are secured about the core such that their tail edges are generally parallel with the dispensing region of the envelope.

12. The dispenser cartridge according to claim 11, wherein the lateral edges of the core extend outwardly from the U-shaped stack of inter-folded sheets a distance of from about 1/16" to about 1/2".

13. The dispenser cartridge according to claim 12, wherein the lateral edges of the core extend outwardly from the U-shaped stack of inter-folded sheets a distance of from about 1/8" to about 1/4".

14. The dispenser cartridge according to claim 11, wherein the lower edge of the core extends outwardly from the U-shaped stack of inter-folded sheets a predetermined distance.

15. The dispenser cartridge according to claim 14, wherein the lower edge of the core extends outwardly from the U-shaped stack of inter-folded sheets a distance of from about 1/16" to about 1/2".

16. The dispenser cartridge according to claim 15, wherein the lower edge of the core extends outwardly from the U-shaped stack of inter-folded sheets a distance of from about 1/8" to about 1/4".

17. The dispenser cartridge according to claim 11, wherein the dispensing region of the shrink wrap envelope is defined by a perforate line.

18. The dispenser cartridge according to claim 17, further comprising a band securing the U-shaped stack to the core.

19. The dispenser cartridge according to claim 18, wherein the band has a perforated area to facilitate rupturing thereof in order to release sheets.

20. The dispenser cartridge according to claim 11, wherein the stack of inter-folded sheets is a stack of single fold inter-folded sheets.

21. The dispenser cartridge according to claim 11, wherein the stack of inter-folded sheets is a stack of inter-folded food service sheets.

22. The dispenser cartridge according to claim 21, wherein the stack of inter-folded sheets is a stack of single fold inter-folded food service sheets.

23. The dispenser cartridge according to claim 22, wherein the single fold inter-folded food service sheets have an overall size of about 6"×10¾".

24. The dispenser cartridge according to claim 22, wherein the single fold inter-folded food service sheets have an overall size of about 8"×10¾".

25. The dispenser cartridge according to claim 22, wherein the single fold inter-folded food service sheets have an overall size of about 10"×10¾".

26. The dispenser cartridge according to claim 22, wherein the single fold inter-folded food service sheets have an overall size of about 12"×10¾".

27. The dispenser cartridge according to claim 22, wherein the single fold inter-folded food service sheets have an overall size of about 15"×10¾".

28. The dispenser cartridge according to claim 21, wherein the stack of inter-folded food service sheets is selected from the group consisting of C-fold inter-folded food service sheets, multi-fold inter-folded food service sheets and Z-fold inter-folded food service sheets.

29. The dispenser cartridge according to claim 22, wherein the stack of inter-folded food service sheets is a stack of inter-folded bakery tissue.

30. The dispenser cartridge according to claim 22, wherein the stack of inter-folded food service sheets is a stack of inter-folded bakery sheets.

31. The dispenser cartridge according to claim 22, wherein the stack of inter-folded food service sheets is a stack of inter-folded deli sheets.

32. The dispenser cartridge according to claim 22, wherein the stack of inter-folded food service sheets is a stack of inter-folded sandwich wrap.

33. A dispenser for dispensing inter-folded sheet comprising:

(a) a dispenser housing configured to receive a replaceable cartridge of inter-folded sheets including a base wall and an upper dispensing wall provided with a dispensing aperture;

(b) biasing means;

(c) the replaceable cartridge of inter-folded sheets comprising:

(i) a stack support member;

(ii) a stack of inter-folded sheets secured about the support member in a U-shape;

(iii) a shrink wrap envelope about the stack securing the U-shaped stack of the inter-folded sheets about the support member, the shrink wrap envelope being provided with a dispensing region, wherein the inter-folded sheets are secured about the support member such that their tail edges are generally parallel with the dispensing region of the envelope, and wherein the support member and the dispenser are configured such that the cartridge is supported so that the dispensing region coincides with the dispensing aperture of the dispenser, (d) wherein the biasing means is adapted to urge the cartridge upwardly so as to maintain the sheets in proximity with the dispensing aperture as the cartridge is consumed.

34. The dispenser according to claim 33, wherein the biasing means comprises a spring member secured to the base wall of the dispenser.

35. The dispenser according to claim 34, wherein the spring member is provided with means for engaging it to the cartridge.

36. A dispenser for dispensing inter-folded sheet comprising:

(a) a dispenser housing including a base wall, two lateral walls, a front wall, a back wall and an upper dispensing wall provided with a dispensing aperture;

(b) a replaceable cartridge of inter-folded sheets disposed in the housing comprising:

(i) a stack support member;

(ii) a stack of inter-folded sheets secured about the support member in a U-shape;

(iii) a shrink wrap envelope about the stack securing the U-shaped stack of the inter-folded sheets about the support member, the shrink wrap envelope being provided with a dispensing region, wherein the inter-folded sheets are secured about the support member such that their tail edges are generally parallel with the dispensing region of the envelope, and wherein the support member and the dispenser are configured such that the cartridge is supported so that the dispensing region coincides with the dispensing aperture of the dispenser, wherein the front and back wall of the dispenser housing are of a first height of lesser height than a second, central height of the sidewalls of the housing in order to facilitate replacement and loading of the cartridge.

37. The dispenser according to claim 36, wherein the sidewalls of the container have raised central support portions for receiving the replaceable cartridge.

38. The dispenser according to claim 37, wherein the sidewalls of the container have an apex at their central portions and decrease in height toward the back and front walls of the housing.

39. The dispenser according to claim 38, wherein the front, back and sidewalls of the housing are of equal height at junctures thereof.

40. A dispenser for dispensing inter-folded sheet comprising:

(a) a dispenser housing including an upper dispensing wall provided with a dispensing aperture;

(b) a replaceable cartridge of inter-folded sheets disposed in the housing comprising:

(i) a stack support member having a length, L;

(ii) a stack of inter-folded sheets secured about the support member in a U-shape;

(iii) a shrink wrap envelope about the stack securing the U-shaped stack of the inter-folded sheets about the support member, the shrink wrap envelope being provided with a dispensing region, wherein the inter-folded sheets are secured about the support member such that their tail edges are generally parallel with the dispensing region of the envelope, and wherein the support member and the dispenser are configured such that the cartridge is supported so that the dispensing region coincides with the dispensing aperture of the dispenser; and (c) a removable adapter for disposing inside of the housing at a predetermined location configured to provide support for the cartridge stack support member of length, L.

41. The dispenser according to claim 40, wherein the adapter is a generally planar member and the housing is provided with at least one slot to receive the adapter plate.

42. The dispenser according to claim 40, wherein the adapter plate has means for supporting a replaceable cartridge of inter-folded sheet on both sides thereof.

43. The dispenser according to claim 42, wherein the adapter plate is centrally disposed within the housing whereby the dispenser is configured to receive at least two replaceable cartridges of inter-folded sheet.

44. A replaceable cartridge of inter-folded sheet comprising:

(a) a stack support member;

(b) a stack of inter-folded sheets secured about the support member in a U-shape;

(c) a shrink wrap envelope about the stack securing the U-shaped stack of the inter-folded sheets about the support member, the shrink wrap envelope being provided with a dispensing region, wherein the inter-folded sheets are secured about the support member such that their tail edges are generally parallel with the dispensing region of the envelope.

45. The cartridge according to claim 44, wherein the support member is a rectangular support member.

46. A method of dispensing a stack of inter-folded sheet comprising:

(a) providing a dispenser cartridge comprising a generally planar rectangular core defining:

(i) an upper edge, a lower core edge and two lateral core edges;

(ii) a stack of inter-folded sheets wrapped about the upper edge of the generally planar rectangular core in a U-shape, the stack and core being sized such that lateral edges of the core extend outwardly from the U-shaped stack a predetermined distance therefrom; and (iii) a shrink wrap envelope about the stack securing the U-shaped stack of inter-folded sheets about the core, the shrink wrap envelope being provided with a dispensing region generally parallel to the upper edge of the core, wherein the inter-folded sheets are secured about the core such that the tail edges are generally parallel with the dispensing region of the envelope;

(b) securing the cartridge in a dispenser housing provided with sidewalls and a base wherein the sidewalls of the dispenser have support channels configured to receive the lateral edges of the rectangular core extending from the U-shaped stack by way of engaging the lateral edges of the core in the support channels of the dispenser sidewalls and wherein the shrink wrap envelope remains in place between the core and support channels of the dispenser;

(c) fracturing the shrink wrap envelope of the cartridge along the dispensing region of the envelope; and (d) withdrawing an inter-folded sheet from the stack.

* * * * *